US010427837B2

(12) United States Patent
Balazs et al.

(10) Patent No.: US 10,427,837 B2
(45) Date of Patent: Oct. 1, 2019

(54) CONTAINER WITH FEATURE TO BLOCK FORK TINE OPENINGS

(71) Applicant: ORBIS Corporation, Oconomowoc, WI (US)

(72) Inventors: Donald J. Balazs, Oconomowoc, WI (US); Link Jay Greiveldinger, Menomonee Falls, WI (US); Scott J. Buss, Watertown, WI (US)

(73) Assignee: ORBIS Corporation, Oconomowoc, WI (US)

( * ) Notice: Subject to any disclaimer, the term of this patent is extended or adjusted under 35 U.S.C. 154(b) by 413 days.

(21) Appl. No.: 15/095,460

(22) Filed: Apr. 11, 2016

(65) Prior Publication Data

US 2016/0304243 A1 Oct. 20, 2016

Related U.S. Application Data

(60) Provisional application No. 62/149,857, filed on Apr. 20, 2015.

(51) Int. Cl.
*B65D 25/28* (2006.01)
*B65D 21/02* (2006.01)

(52) U.S. Cl.
CPC ..... *B65D 25/282* (2013.01); *B65D 21/0213* (2013.01); *B65D 2213/00* (2013.01)

(58) Field of Classification Search
CPC .. B65D 25/282; B65D 25/2802; B65D 25/28; B65D 25/00; B65D 21/0213; B65D 21/0209; B65D 21/0215
See application file for complete search history.

(56) References Cited

U.S. PATENT DOCUMENTS

| | | | | |
|---|---|---|---|---|
| 4,044,910 | A | 8/1977 | Box | |
| 4,192,430 | A | 3/1980 | Cornou | |
| 4,288,134 | A * | 9/1981 | Knaack | A47B 81/00 312/100 |
| 4,300,695 | A | 11/1981 | Hsu | |
| D271,153 | S | 10/1983 | Deaton | |
| D277,042 | S | 1/1985 | Carter et al. | |
| 4,491,231 | A | 1/1985 | Heggeland et al. | |
| 4,591,065 | A | 5/1986 | Foy | |
| 4,674,647 | A | 6/1987 | Gyenge et al. | |
| 4,775,068 | A | 10/1988 | Reiland et al. | |
| 4,917,255 | A | 4/1990 | Foy et al. | |
| 4,923,079 | A | 5/1990 | Foy | |
| 4,967,927 | A | 11/1990 | Reiland et al. | |
| 4,987,639 | A | 1/1991 | Baiuley et al. | |
| 5,094,356 | A | 3/1992 | Miller | |
| 5,114,037 | A | 5/1992 | Hillis et al. | |

(Continued)

FOREIGN PATENT DOCUMENTS

| | | | |
|---|---|---|---|
| CA | 2927787 | C | 2/2018 |
| DE | 102004012198 | A1 | 9/2005 |

(Continued)

*Primary Examiner* — Steven A. Reynolds
*Assistant Examiner* — Javier A Pagan
(74) *Attorney, Agent, or Firm* — Greensfelder, Hemker & Gale, P.C.

(57) ABSTRACT

A tote style container with a first handle and second handle that can be picked up by a fork tine is provided. The container includes features for blocking the tine of lower containers when in a stack of like containers.

10 Claims, 8 Drawing Sheets

(56) References Cited

U.S. PATENT DOCUMENTS

| | | | | |
|---|---|---|---|---|
| 5,199,592 | A | 4/1993 | Reiland et al. | |
| 5,289,935 | A | 3/1994 | Hillis et al. | |
| 5,462,221 | A | 10/1995 | Zink et al. | |
| 5,467,885 | A | 11/1995 | Blinstrub | |
| 5,474,197 | A | 12/1995 | Hillis et al. | |
| 5,538,178 | A | 7/1996 | Zink et al. | |
| 5,555,980 | A | 9/1996 | Johnston et al. | |
| 5,632,392 | A | 5/1997 | Oh | |
| 5,711,444 | A | 1/1998 | Meacham et al. | |
| 5,797,508 | A | 8/1998 | Loftus et al. | |
| 5,845,799 | A | 12/1998 | Deaton | |
| 5,860,527 | A | 1/1999 | Frankenberg et al. | |
| 5,908,135 | A | 6/1999 | Bradford et al. | |
| 6,015,056 | A | 1/2000 | Overholt et al. | |
| 6,135,287 | A | 10/2000 | Hartwall | |
| 6,189,695 | B1 | 2/2001 | Chin-rong | |
| 6,283,319 | B1 | 9/2001 | Hillis et al. | |
| 6,290,081 | B1 | 9/2001 | Merey | |
| 6,293,418 | B1 | 9/2001 | Ogden et al. | |
| 6,416,271 | B1 | 7/2002 | Piggot et al. | |
| 6,422,409 | B2 | 7/2002 | Kofod | |
| 6,484,898 | B2 | 11/2002 | Hillis et al. | |
| 6,619,540 | B1 | 9/2003 | Bazany | |
| 6,691,885 | B2 | 2/2004 | Brown | |
| 6,726,046 | B2 | 4/2004 | Orset | |
| 6,776,300 | B2 | 8/2004 | Walsh et al. | |
| 6,805,254 | B2 | 10/2004 | Tanzer et al. | |
| 6,877,628 | B2 | 4/2005 | Nesting | |
| 6,902,061 | B1 | 6/2005 | Elstone | |
| 6,955,273 | B2 | 10/2005 | Hartwall | |
| 6,966,449 | B2 | 11/2005 | Williams | |
| 7,032,765 | B2 | 4/2006 | Miller et al. | |
| 7,137,522 | B2 | 11/2006 | Dubois | |
| 7,195,127 | B2 | 3/2007 | Hsu et al. | |
| 7,287,661 | B2 | 10/2007 | Knutsson et al. | |
| 7,347,328 | B2 | 3/2008 | Hartwall | |
| 7,416,092 | B2 | 8/2008 | Dubois et al. | |
| 7,484,621 | B2 * | 2/2009 | Apps | B65D 21/062 206/506 |
| 7,484,634 | B2 * | 2/2009 | Apps | B65D 19/18 220/6 |
| 7,861,458 | B2 | 1/2011 | Apps et al. | |
| 8,413,831 | B2 | 4/2013 | Nolan | |
| 9,669,959 | B2 | 6/2017 | Luburic | |
| 2002/0108950 | A1 | 8/2002 | Moorman et al. | |
| 2003/0230510 | A1 | 12/2003 | Aiken et al. | |
| 2004/0182858 | A1 | 9/2004 | Smyers | |
| 2004/0200833 | A1 | 10/2004 | Dubois et al. | |
| 2007/0029319 | A1 | 2/2007 | Speck | |
| 2007/0068941 | A1 | 3/2007 | Dubois | |
| 2007/0075077 | A1 | 4/2007 | Doubois et al. | |
| 2007/0221718 | A1 | 9/2007 | Nyeboer | |
| 2007/0221719 | A1 | 9/2007 | Vroon et al. | |
| 2007/0221720 | A1 | 9/2007 | Nyeboer | |
| 2007/0221721 | A1 | 9/2007 | Bradford | |
| 2008/0169285 | A1 | 7/2008 | Marazita et al. | |
| 2008/0203089 | A1 | 8/2008 | Hartwall | |
| 2009/0044376 | A1 | 2/2009 | Nolan | |
| 2009/0134176 | A1 | 5/2009 | Yamauchi | |
| 2009/0152265 | A1 | 6/2009 | Nolan | |
| 2009/0266813 | A1 | 10/2009 | Afflerbach et al. | |
| 2010/0051497 | A1 | 3/2010 | Meers | |
| 2010/0072199 | A1 | 3/2010 | Manuel | |
| 2013/0001225 | A1 | 1/2013 | Samprathi | |
| 2016/0257445 | A1 | 9/2016 | Balazs et al. | |

FOREIGN PATENT DOCUMENTS

| | | | |
|---|---|---|---|
| EP | 1019293 | B1 | 5/2002 |
| EP | 1440011 | B1 | 6/2006 |
| EP | 1927552 | A2 | 6/2008 |
| EP | 1616803 | B1 | 10/2009 |
| GB | 2426237 | B | 12/2008 |
| MX | 2016004978 | A | 10/2016 |
| WO | 00/27716 | A1 | 5/2000 |
| WO | 01/76930 | A1 | 10/2001 |
| WO | 03/024815 | A1 | 3/2003 |
| WO | 03/029090 | A1 | 4/2003 |
| WO | 03/074376 | A1 | 9/2003 |
| WO | 2005/102852 | A1 | 11/2005 |
| WO | 2006/062894 | A2 | 6/2006 |

* cited by examiner

CONTAINER WITH FEATURE TO BLOCK FORK TINE OPENINGS

CROSS-REFERENCE TO RELATED APPLICATIONS

This application claims the benefit of U.S. Provisional Patent Application No. 62/149,857, filed Apr. 20, 2015, the contents of which are hereby incorporated in their entirety by reference and made a part hereof.

FEDERALLY SPONSORED RESEARCH OR DEVELOPMENT

N/A

FIELD OF THE INVENTION

The present invention generally relates to features for blocking fork tine openings in a container, and more particularly, to features for blocking openings for a single fork tine on stacked containers.

BACKGROUND OF THE INVENTION

Today, bulk parts are packaged in a number of different ways. Many of these ways incorporate reusable containers that require a fork truck or other similar material handling equipment for transport. To improve product density, material handling flexibility and presentation to the assembly line, the designs of such containers are becoming more custom for a specific use or need.

Within the various designs of such custom containers exist containers that can only be carried by one fork tine. For example, the Assignee of the present invention has developed a tote style container having two handles connected to the top portion of the end walls, that form a gap or opening sized and positioned for accepting a single tine of a fork truck or other similar equipment. While transporting a single container in this manner is acceptable, transporting a stack of containers using one fork tine (i.e., on the lowest container of the stack) creates safety concerns. Specifically, the load may rotate about the tine and tip over during lifting or transport.

The present invention provides an improved container having features that block a fork tine when stacked with other containers. Only the topmost container in the stack of containers allows the fork tine to be used.

SUMMARY OF THE INVENTION

The present invention provides a plastic tote style container with features for blocking a fork tine in a stack of like containers.

In accordance with one embodiment of the invention, a container having blocking features to prevent a fork tine from picking up a stack of like containers is provided. The container comprises a container body having a bottom wall, a first side wall, an opposing second side wall, a first end wall and an opposing second end wall. The container body is preferably formed from a molded plastic or other similar suitable material. A first handle is connected to a top portion of the first end wall and forms a first opening, and a second handle is connected to a top portion of the second end wall and forms a second opening aligned with the first opening. The handles are preferably bolted to the container body. The first and second openings are sized and positioned to receive a tine of a fork truck. The container further includes a first lower wall extending downward from the bottom wall of the container body. The lower wall is positioned to block the first opening in a lower like container. In this manner, only the topmost container can be picked up with the fork tine using the handles.

The first lower wall can extend from the first side wall to the second side wall, or a portion thereof. The first lower wall can be positioned proximate the first end wall, or can be placed at any position between the first end wall and the second end wall.

The container can include a second lower wall extending from the bottom wall of the container to block the second opening. The second lower wall can be positioned proximate the second end wall.

The container can include a plurality of shoulder portions extending upward from corners formed by the end walls and side walls. The container can also include a plurality of feet extending downward from the bottom wall where each foot is proximate a corner of the bottom wall.

The container body can include a plurality of outwardly extending ribs on the first and second side walls, and first and second end walls. Additionally, the container body can also include one or more flat regions between the outstanding ribs on the side walls and/or end walls for receiving a label.

In accordance with another embodiment of the invention a container having blocking features to prevent a fork tine from picking up a stack of like containers is provided with moveable handles. The container comprises a container body having a bottom wall, a first side wall, an opposing second side wall, a first end wall and an opposing second end wall. A first handle is moveably connected to a top portion of the first end wall. The first handle forms a first opening sized to accept a tine of a fork truck between a top of the first handle and a top edge of the first end wall in a first position, and the first handle prevents a tine of a fork truck from being accepted between the top of the first handle and the top edge of the first end wall in a second position. Downward pressure from an upper like container forces the first handle from the first position to the second position.

The container can also include a second handle moveably connected to a top portion of the second end wall. Like the first handle, the second handle forms a second opening sized to accept a tine of a fork truck between a top of the second handle and a top edge of the second end wall in a first position and prevents a tine of a fork truck from being accepted between the top of the first handle and the top edge of the second end wall in a second position. Again, downward pressure from an upper like container forces the second handle from the first position to the second position.

The handles can include a first downwardly extending arm, a second downwardly extending arm and a horizontal bar extending between the first downwardly extending arm and the second downwardly extending arm. The first arm can be connected to the end wall by a first slideable element, and the second arm can be connected to the end wall by a second slideable element. Preferably, each slideable element includes a spring that is connected to the arm by a rivet.

The container can further comprise corner elements extending upward from the end walls adjacent each side of a handle. The horizontal bar of each handle is preferably level with a top of the corner elements when the handle is in the first position. When pushed into the second position the horizontal bar is flush with the top edge of the end wall.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
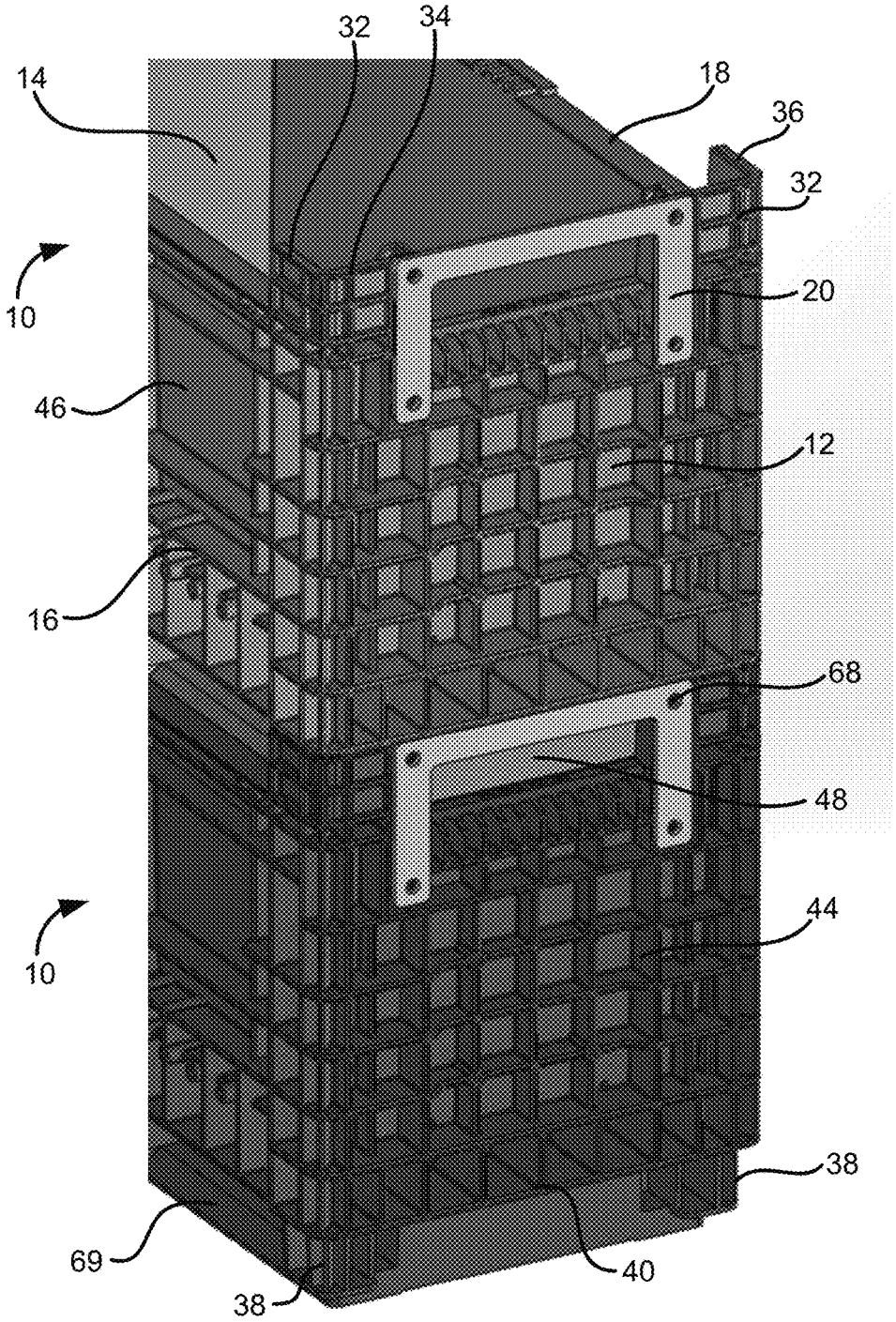
FIG. 1 is a perspective view of a stack of containers having fork tine blocking features in accordance with an embodiment of the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention is directed to features for blocking a tine of a fork truck in a stack of containers. Certain tote style containers have handles that form openings positioned to accept a single tine of a fork truck or other similar device. However, it can be dangerous to lift a stack of such containers using a fork tine. The present containers include features to block the openings of containers below the topmost container of a stack of containers to prevent lifting two or more containers in the stack with the fork tine.

Figure 2:
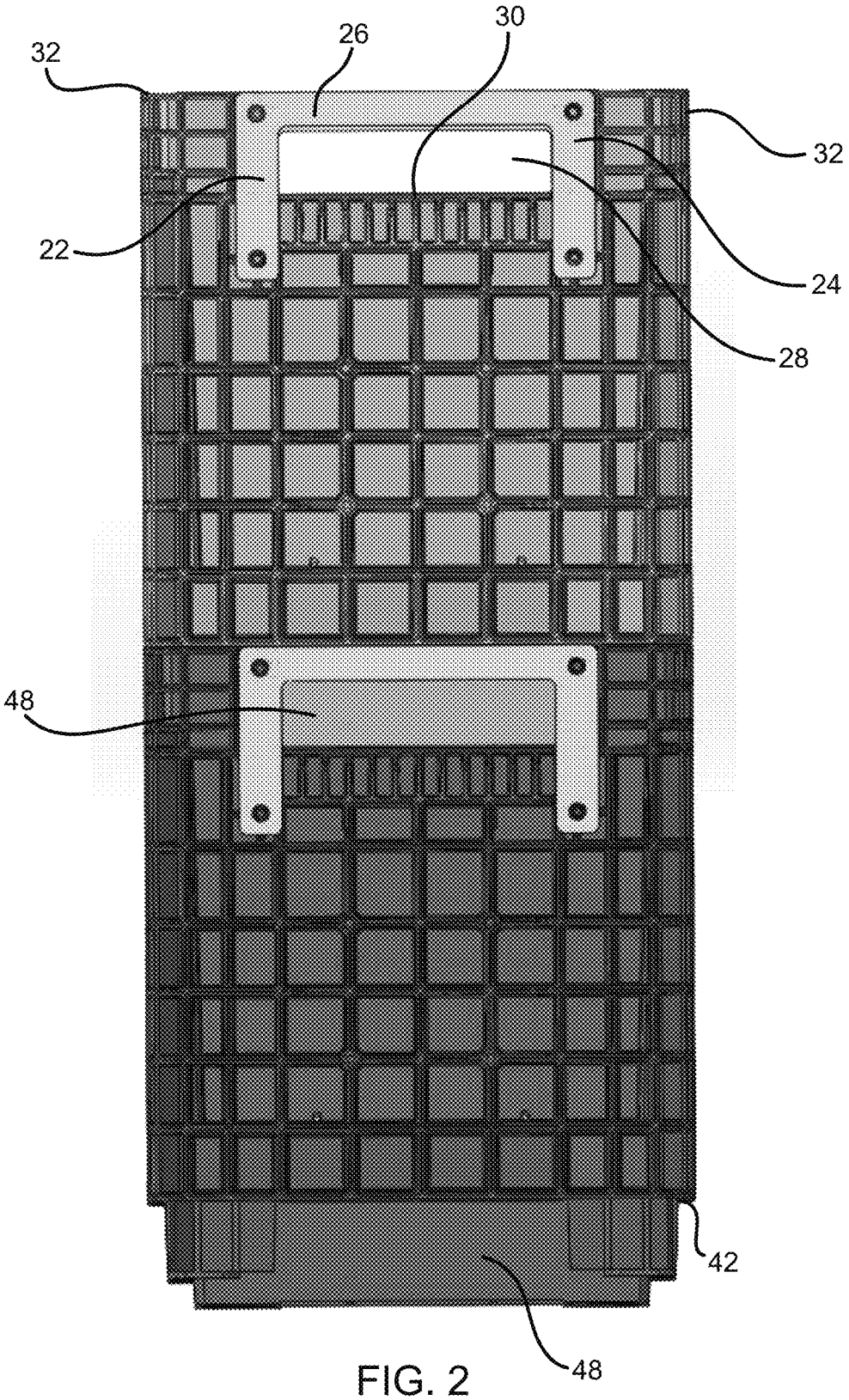
FIG. 2 is a plan view of an end of the stack of containers of FIG. 1.

FIGS. 1 and 2 show two tote style plastic containers 10 stacked one upon the other in accordance with an embodiment of the present invention. Each container 10 includes a generally rectangular horizontal base or bottom wall 40 for supporting goods or other items or material in the tote. Additionally, each container 10 includes a first end wall 12, a second end wall 14 opposing the first end wall 12, a first side wall 16 and a second side wall 18 opposing the first side wall 16 extending upward from the base 12.

Each container 10 includes a first handle 20 connected to a top portion of the first end wall 12, and a second handle (not shown) connected to a top portion of the second end wall 14. The handles include a first arm 22 and a second arm 24 that are secured to the end wall. In one embodiment (shown in FIGS. 1-4 and 8-9) a horizontal bar 26 extends between the first arm 22 and second arm 24. The handles 20 are positioned to form a gap or opening 28 between the horizontal bar 26 and an upper edge 30 of the end wall below the horizontal bar 26.

The container 10 includes shoulder portions 32 that extend upward on either side of each handle 20. The shoulder portions 32 include a first portion 34 that is an upward extension of the respective end wall, and a second portion 36 that is an upward extension of the respective side wall. As shown in the Figures, the first portion 34 of each shoulder portion 32 extends to an arm of one of the handles 20. Both portions 34, 36 of the shoulder portions 32 extend upward to the same height as a top edge of the handle 20 (in another embodiment of the container—shown in FIGS. 6 and 7—a modified handle 67 is shown which extends upward above the should portions of the container).

The container 10 also includes feet 38 extending downward proximate each corner of the bottom wall 40 of the container 10. The feet 38 are positioned slightly inward from the corner to form a slight ledge or overhang 42 as shown in FIG. 2. The ledge 42 is positioned to rest on the top edge of a corner portion 32 when stacked on another like container 10.

As shown in the Figures, each of the end walls 12, 14, side walls 16, 18 and shoulder portions 32 and feet 38 include a plurality of outwardly extending ribs 44. The side walls 16, 18 also can include flat portions 46 that can be used for labels or molded-in indicia. The end walls 12, 14 could also be provided with flat portions.

The openings 28 formed by the handles and the upper edge 30 of the end walls 12, 14 are sized and positioned to receive a single tine of a fork truck. This enables the container 10 and any load contained therein to be lifted by the fork tine. Because only one fork tine can be used to lift the container 10 in this manner, lifting a stack of such containers can be problematic. Specifically, the stack of containers can become unbalanced and the upper containers of the stack could shift and fall.

To prevent attempts to lift a stack of such containers 10, the present containers 10 include features to prevent a fork tine from lifting any but the topmost container of the stack. Specifically, the containers include structure to remove or block the openings formed by the handles of any lower container of a stack of containers. This leaves only the topmost container of the stack having openings that can receive the fork tine.

Referring to FIGS. 1 and 2, each container 10 includes a lower blocking wall 48 extending downward from the bottom wall 40 proximate the first end wall 12. The blocking wall 48 extends along at least a central portion between the first side wall 16 to the second side wall 18.

As illustrated in FIG. 2, when a first container 10 is stacked on a second lower container 10, the blocking wall 48 of the first container 10 blocks the opening 28 of the bottom container 10. This effectively prevents a tine from a fork truck from passing through one of the openings 28 formed by the first and second handles, and extending through the other of the openings 28. While the blocking wall 48 is shown as a solid wall portion, other blocking wall structures could be used (e.g., a series of spaced posts or wall segments, a wall portion with small openings, etc.). Additionally, the blocking wall 48 only needs to be large enough to the block the openings 28 and does not necessarily have to extend the full width of the container from the first side wall 16 to the second side wall 18.

Moreover, in an alternative embodiment of the invention, the blocking wall 48 can extend downward from the bottom wall 14 at any location between the first end wall 12 and the second end wall 14. Additionally, more than one blocking wall 48 can be used (e.g., one proximate the opening of the first handle, and one proximate the opening of the second handle).

Figure 6:
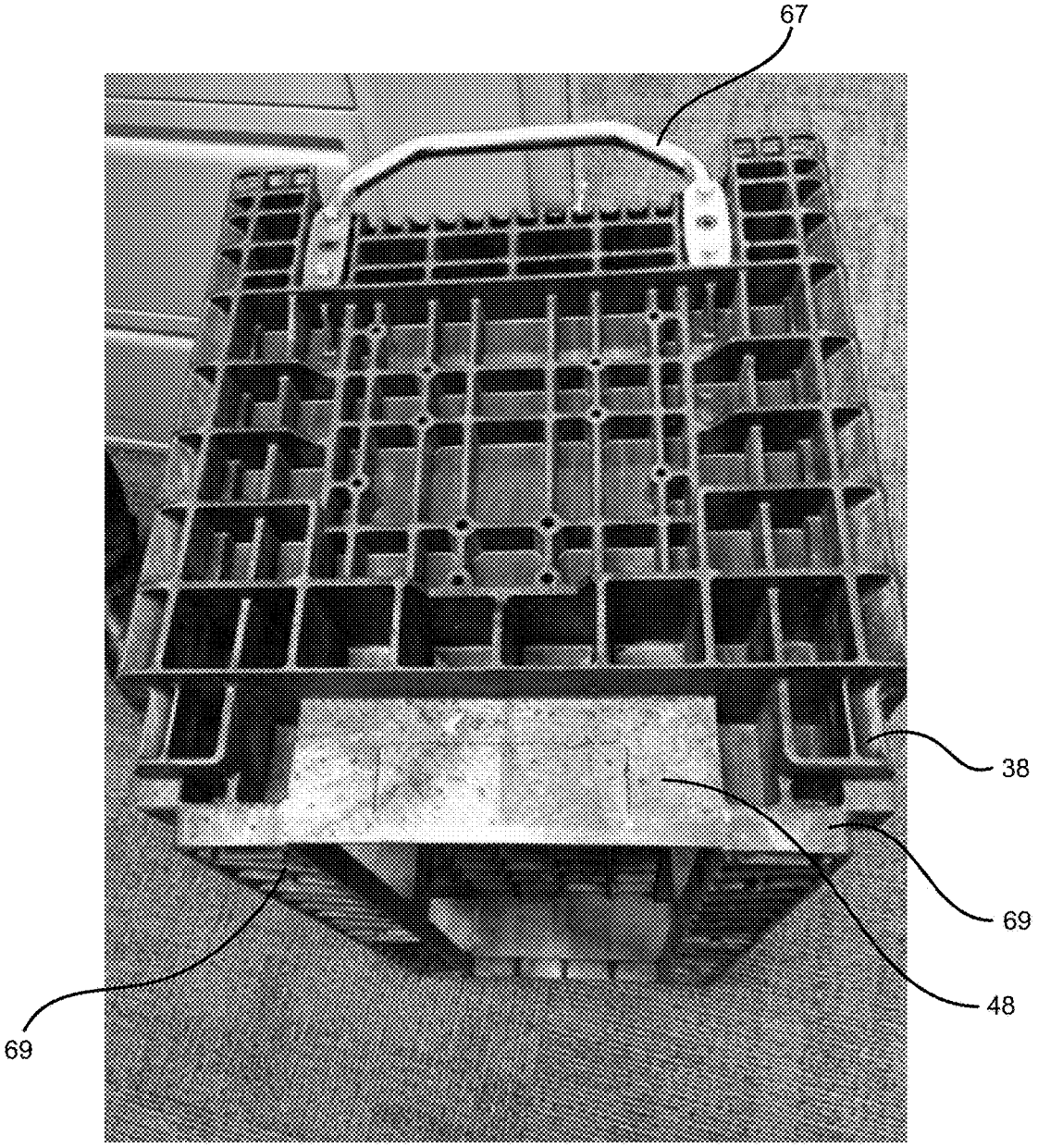
FIG. 6 is a perspective view of another embodiment of the container resting on an end wall.
Figure 7:
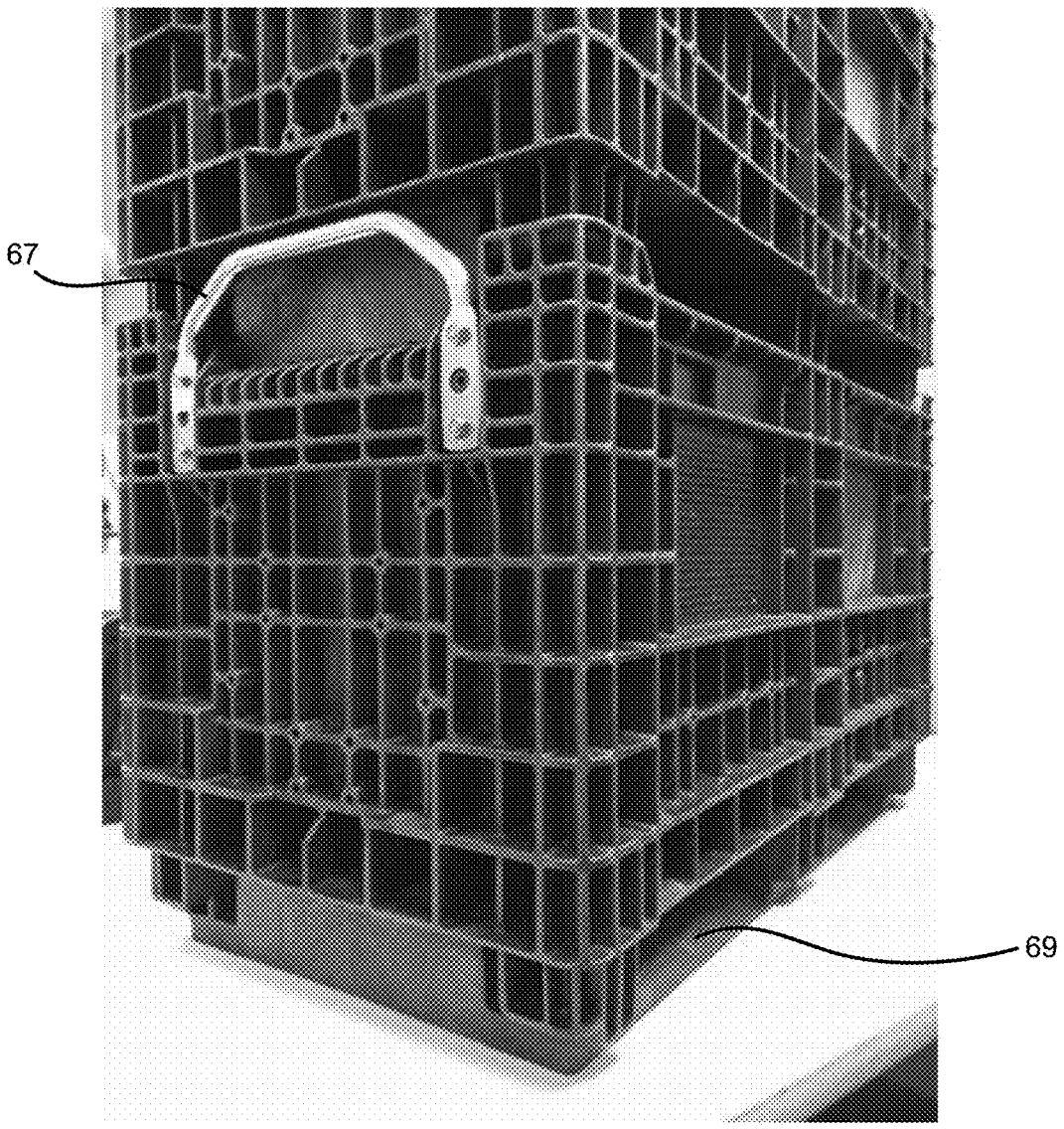
FIG. 7 is a perspective view of two of the containers of FIG. 6 stacked one on top of the other.

As more fully illustrated in FIGS. 6 and 7, the first blocking wall 48 extends downward to a first runner and a second runner 69 below the feet 38. The runners 69 extend from proximate the first end wall 12 to proximate the second end wall 14. A second blocking wall 48 can extend between the runners 69 proximate the second end wall 14.

Figure 3:
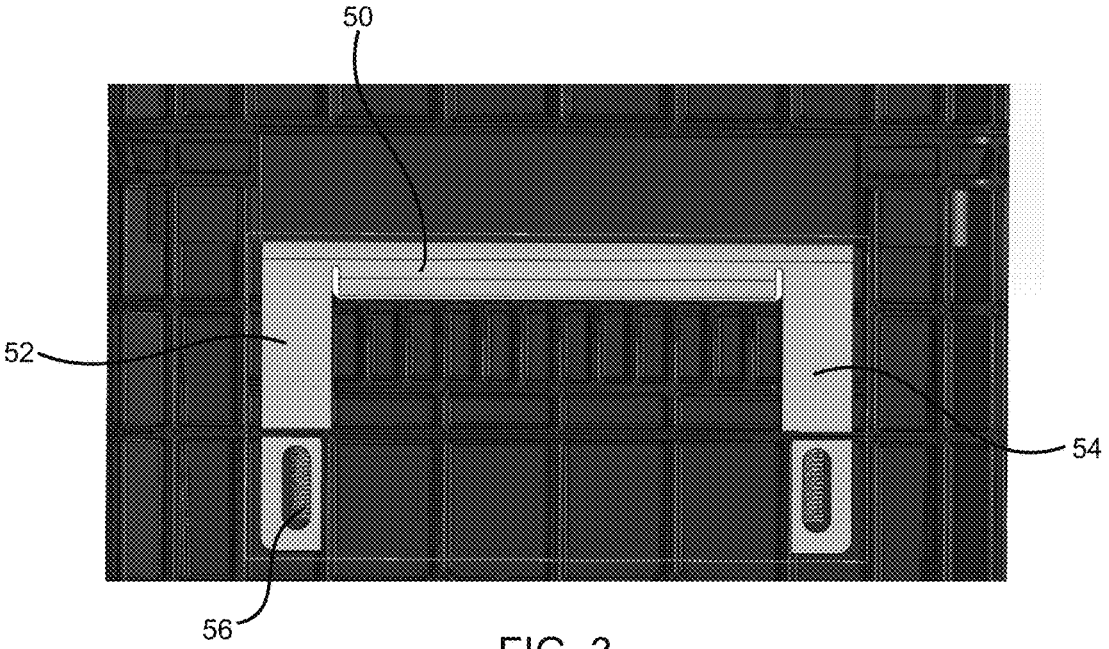
FIG. 3 is an end plan view of a container having fork tine blocking features in accordance with another embodiment of the present invention with a partial like container stacked thereon.
Figure 4:
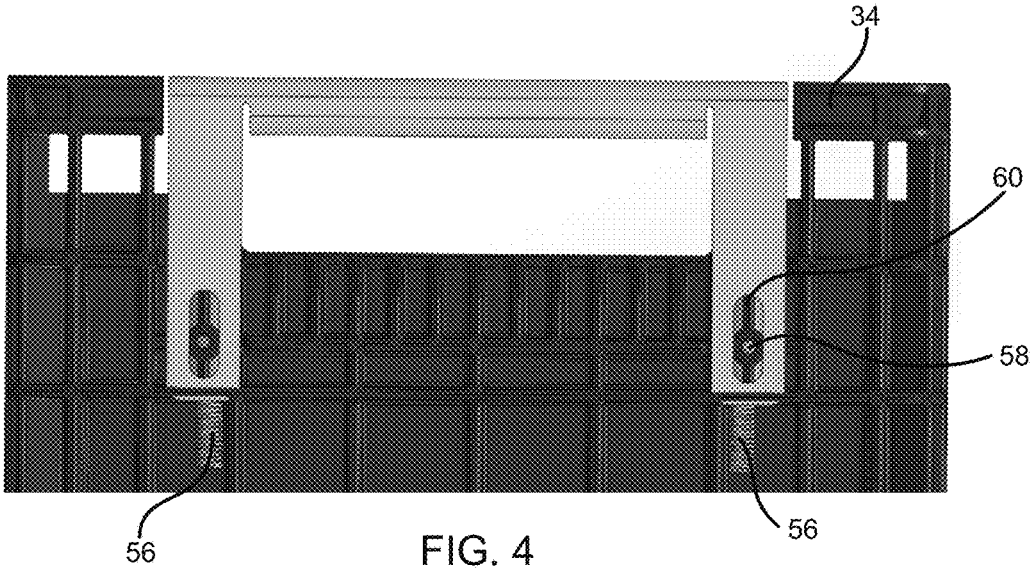
FIG. 4 is an end plan view of the container of FIG. 3 without the like container stacked thereon.

An alternative and/or additional embodiment is illustrated in FIGS. 3 and 4. In this embodiment, the container 10 includes a handle 50 having a spring-loaded connection to the end wall. As shown, each arm 52, 54 of the handle 50 is connected to a spring 56. The springs 56 are held in place along the end wall and are connected to rivets 58 that extend through a slot 60 in each handle arm 52, 54.

FIG. 4 shows the handle 50 in a fully upward extended position exposing the opening 28. This occurs for the topmost container of a stack of containers, or any container without another one stacked thereon.

FIG. 3 shows the handle 50 in a lowered position with a container stacked on top of the handle 50. The upper container is provided with structure 62 to compress the handle 50 downward. The compressing structure can be formed in the feet of the upper container (e.g., a horizontal extension of the foot inward sufficient to contact the handle) or can extend from the bottom wall 40 (e.g., such as the blocking walls—if positioned proximate the end walls).

Figure 5:
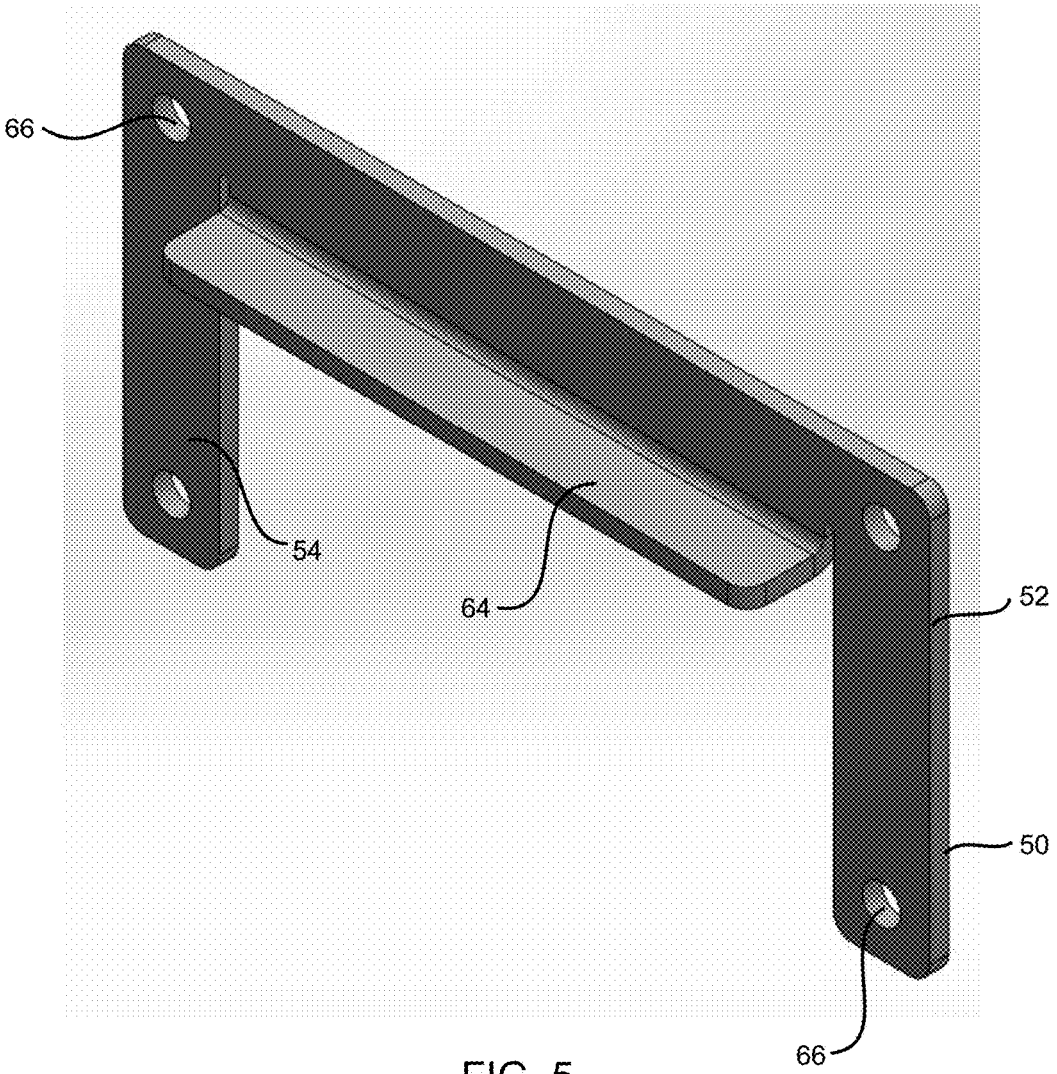
FIG. 5 is a perspective view of a handle of the container.

As shown in FIG. 5, the handle 20 can include a flat horizontal segment 64 that can be used by the compressing structure of an upper container. This flat segment 64 can also be used for additional support when the container is lifted by a tine of a fork truck.

FIG. 5 also shows the handle having a plurality of openings 66. The openings 66 are used to accommodate screws or bolts 68 used to fasten the handle 50 to the end wall of the container 10.

Figure 8:
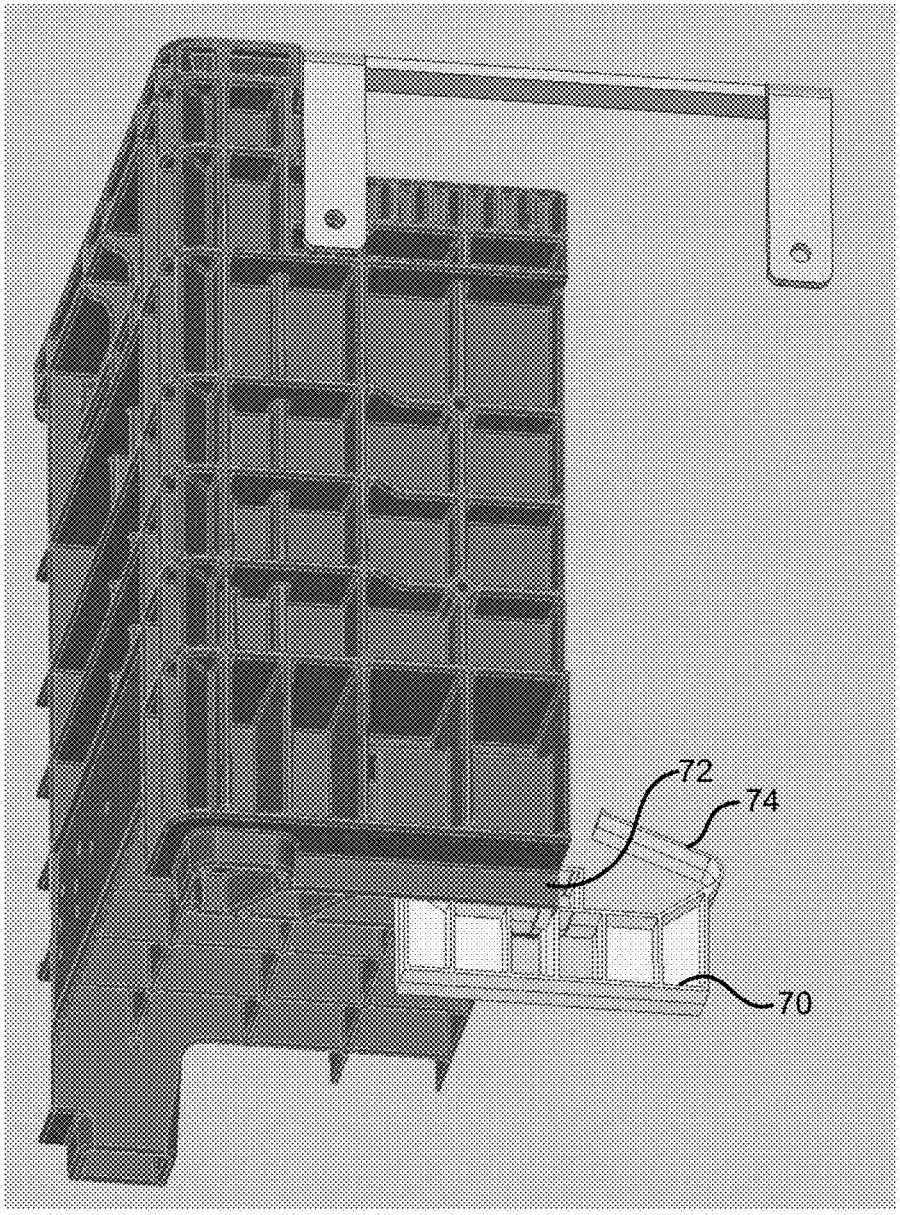
FIG. 8 is a perspective view of a partial container in accordance with another embodiment of the invention showing a spring-loaded lower blocking plate; and, FIG. 9 is a perspective view of the partial container of FIG. 8 showing the spring-loaded lower blocking plate compressed into the end wall of the container.
Figure 9:
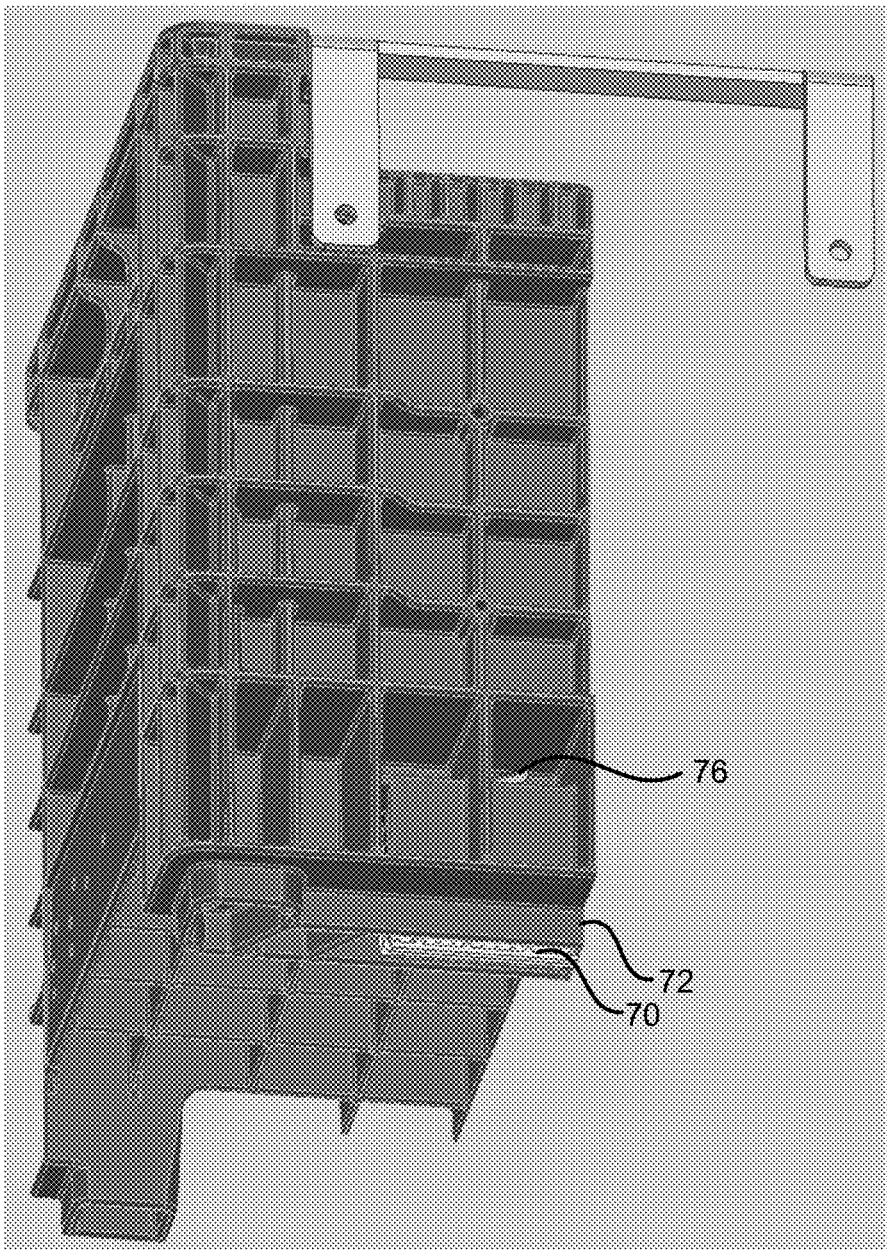

In a further embodiment of the invention illustrated in FIGS. 8 and 9, the containers can be provided with a lower spring-loaded blocking element 70. The spring-loaded blocking element 70 fits into a cavity or pocket 72 having an opening in the bottom of an end wall. The spring-loaded blocking element includes first and second leaf spring member 74, 76. When the container is placed on a floor, the spring-loaded blocking element is compressed into the pocket 72 as shown in FIG. 9. When stacked on another container, the spring elements 74, 76 are biased to force the element 70 downward so that it is positioned to block the opening formed by the handle of the container below it. A conventional detent or other similar feature is provided to keep the element connected to the container when it is extended downward. As evident in FIGS. 8 and 9, this embodiment does not necessarily include runners.

As described herein, each container in the stack of containers is a "like" container. This does not mean that the containers are necessarily identical (although they are preferably identical). Rather, each of the containers merely needs to have enough features in common to stack with each other and to allow for handling by a fork tine in the manner described.

Many modifications and variations of the present invention are possible in light of the above teachings. It is, therefore, to be understood within the scope of the appended claims the invention may be protected otherwise than as specifically described.

We claim:

1. A tote style container having blocking features to prevent a fork tine from picking up a stack of like containers comprising:

a container body having a bottom wall, a first side wall having a top edge, an opposing second side wall having a first side edge, a second side edge and a top edge, a first end wall having a first side edge, a second side edge and a top edge and an opposing second end wall having a first side edge, a second side edge and a top edge, wherein adjacent side edges of the side walls and end walls form four corners of the container body;

four corner portions extending upward past the top edges of the first and second side walls and first and second end walls, one each of the four corner portions located at each of the four corners of the container body;

a first handle connected to a top portion of the first end wall and forming a first opening between a first two of the four corner portions;

a second handle connected to a top portion of the second end wall and forming a second opening between a second two of the four corner portions, where the second opening is aligned with the first opening, the first and second openings sized and positioned to receive a tine of a fork truck; and, a first lower wall extending downward from the bottom wall of the container body, the first lower wall positioned to block the first opening in a lower like container when stacked on the lower like container.

2. The container of claim 1 wherein the first lower wall extends from the first side wall to the second side wall.

3. The container of claim 1 wherein the first lower wall is proximate the first end wall.

4. The container of claim 3 further comprising a second lower wall extending from the bottom wall of the container, the second lower wall positioned to block the second opening.

5. The container of claim 4 wherein the second lower wall is proximate the second end wall.

6. The container of claim 1 further comprising a plurality of feet extending downward from the bottom wall, each foot proximate a corner of the bottom wall.

7. The container of claim 1 wherein the container body is formed from plastic.

8. The container of claim 7 further comprising a plurality of outwardly extending ribs on the first and second side walls, and first and second end walls.

9. The container of claim 8 further comprising a flat region between the outstanding ribs on the first side wall for receiving a label.

10. The container of claim 1 wherein the first handle is bolted to the first end wall and the second handle is bolted to the second end wall.

* * * * *